US005716075A

United States Patent [19]

Evert, Jr.

[11] Patent Number: 5,716,075

[45] Date of Patent: Feb. 10, 1998

[54] BINDING PRODUCT HOLDER

[76] Inventor: John R. Evert, Jr., 210 Southland Station #216, Warner Robbins, Ga. 31088

[21] Appl. No.: 554,765

[22] Filed: Nov. 7, 1995

[51] Int. Cl.[6] ..... B42D 3/00

[52] U.S. Cl. ..... 281/31; 281/29; 206/232; 206/472

[58] Field of Search ..... 206/214, 232, 206/446, 472, 581, 813; 281/29, 31

[56] References Cited

U.S. PATENT DOCUMENTS

| | | | |
|---|---|---|---|
| 378,928 | 3/1888 | Goldsmith | 206/214 |
| 1,218,849 | 3/1917 | Frederickson | 206/214 |
| 1,436,184 | 11/1922 | Mason, Jr. | 206/214 |
| 1,848,981 | 3/1932 | Walker | 281/31 |
| 4,177,812 | 12/1979 | Brown et al. . | |
| 4,369,882 | 1/1983 | Schluger | 206/232 |
| 4,492,306 | 1/1985 | Cooper et al. | 206/232 |
| 4,925,029 | 5/1990 | Friedman et al. | 206/581 |
| 5,072,831 | 12/1991 | Parrotta et al. | 206/232 |
| 5,111,953 | 5/1992 | Faust et al. | 220/359 |
| 5,368,333 | 11/1994 | Arroyo | 281/29 |

*Primary Examiner*—David T. Fidei
*Attorney, Agent, or Firm*—Grimes & Battersby

[57] ABSTRACT

A device and method for the packaging and distribution of sample products to consumers along with a publication, whereby said product samples are enclosed within product sample holders and inserted into a rectangular tube made of transparent plastic material having at least one planar surface. The planar surface of the rectangular tube is then secured against the square binding of a magazine or publication by means of clear adhesive tape, thereby allowing the product samples to be distributed to magazine subscribers or at newsstands.

7 Claims, 2 Drawing Sheets

70
71
72

70
71
72

40

30

30
31
40
10
5
21
40
40
25
20
22

BINDING PRODUCT HOLDER

1. FIELD OF THE INVENTION

The present invention relates generally to a device and method for the packaging and distribution of products, and, more particularly, to a method and device which permits the products to be packaged and displayed along the binding of a publication or an object of similar size and/or design with at least one planar surface to which the device may be attached.

Corporations devote considerable time and resources in advertising and promoting their products, and, more particularly, in giving away sample trial portions of their products for consumers to examine. It is, however, difficult to place those products into the hands of the desired target audience. While direct mail advertising has proven to be an effective means of product promotion, the very nature of the medium makes it difficult to place product samples into the hands of the target consumers. Although product samples may be sent to the general public through the mail along with literature describing the product, this method does not always place the product with the most-desired class of consumers. Further, the advertising material and product sampler often arrive at different times, which dilutes the impact of the advertising, particularly when the advertising literature is disposed of summarily.

Incorporating a product sample in a magazine is also a common practice. By directing their sample products to select magazine subscribers, advertisers may effectively reach a desired group of potential customers. An advertisement is usually placed within the magazine in question, accompanied by the occasional flat sample of a product, such as, for example, a fragrance. However, due to the limitations of the design of a magazine, it is impractical to include any kind of sample having significant three-dimensional shape (such as a small shampoo bottle), as it would prevent the subject magazine from closing.

The present invention is designed to provide a means for distributing sample materials and promotional items efficiently and selectively, therefore providing a more efficient utilization of limited corporate resources. The present invention discloses a product sample holder which is lightweight, inexpensive and efficient and is designed to be utilized in conjunction with magazines or publications with a square, glued binding. The design of the present invention permits easy insertion of product samples and secure closure of the holder by means of a closure plug and adhesive seal and is easily attached to the square binding of a magazine or publication by means of flexible, clear adhesive tape. Once attached, it is a unique feature of the holder of the present invention, and a significant improvement over the prior art, in that it will not interfere with the mailing or newsstand distribution of the attached magazine, thereby ensuring that the targeted consumers will receive their publication with all of the samples intact. Further, the clear plastic tubing of the preferred embodiment of the subject holder allows for easy identification of the samples enclosed therewith. It is also a feature of the present invention that the use of a flexible clear adhesive tape as a fastening means does not affect the front and rear covers of the magazine, thereby preserving the integrity of costly advertising space as well as the aesthetic appeal of the subject publication.

As will be seen, the unique design of the holder of the present invention also permits the magazine subscriber or newsstand purchaser to easily detach the subject holder and remove the product samples. Thus, it provides an effective means for distributing sample products to a select class of consumers without the limitations inherent in other methods and devices for sample distribution.

2. DESCRIPTION OF THE PRIOR ART

Several patents directed to the promotion of advertising goods, or to the incorporation of goods within a publication, are known in the prior art. For example, U.S. Pat. No. 1,848,980 to Walker discloses a pencil holder adapted to engage the grooves of the binding of a book. However, Walker requires the use of a semicircular tube open on one side, as opposed to a tube which is totally enclosed, with a hinged latch at one end. Walker's device relies on friction to maintain contact with the binding of a book, and would therefore not be appropriate for attachment to the binding of a magazine or other object with a planar surface. Further, a book incorporating Walker would be damaged in the event that a liquid sample were to burst inside this holder. Additionally, books incorporating Walker's device would not be "stackable."

U.S. Pat. No. 4,369,882 to Schluger discloses a paperboard sample container for use in direct mail advertising. There are many disadvantages with such a device, however, that are not found in the present invention. For example, Schluger effectively doubles the thickness of a publication by, in effect, covering the whole back of the publication with the sample container, which would lead to significantly increased production and shipping costs, as the shipper could only stack half as many publications in the same amount of space for distribution. Further, covering up the back of a publication necessarily obscures the rear cover advertising, which is one of the most desirable advertising spots in any publication. Clearly, any advertiser that would pay a premium to be on the back cover would not want its expensive advertisement to be obscured, nor would the publication's owners necessarily be willing to forsake this valuable advertising space. In addition, because of its obvious bulk and limited flexibility, the Schluger device, when combined with a standard 8.5" by 11" publication, may not be flexible enough to fit into most mailboxes. The use of Schluger would also prevent one from reading the subject publication at a newsstand without tearing it apart. Further, since the samples are on the back page, they cannot be seen from the front, which is the way a magazine is typically displayed. U.S. Pat. No. 4,711,348, also to Schluger, is a product sample mailer and is not designed to be attached to a publication.

U.S. Pat. No. 4,492,306 to Cooper discloses and claims a removable sample pouch bound into the spine of a magazine. This requires a special procedure during production of the subject publication to attach a page in the center of the magazine and stitch it to the publication's spine. This is unlike the holder of the present invention in which the holder is attached after publication thereby preventing the entire publication process from having to be redesigned. Further, the use of the pouches disclosed in Cooper would not protect the samples from being crushed or damaged by the weight of a stack of magazines, and would alter the appearance of the publication by creating a bulge in its middle. This is in contrast to the holder of the instant invention which is designed to ride along the binding. Cooper requires the use of costly VELCRO or ZIPLOCK closure devices and places the samples inside the magazine, in a less visible spot.

U.S. Pat. No. 4,968,061 to Bullard Jr. discloses an advertising booklet which is adapted to hold a sample of the goods being advertised through a plurality of slots extending partially through the pages. This is impractical for use in a magazine as it would require cutting holes in the publication, thereby rendering articles unreadable. Alternatively it could force a redesign of the entire format of the subject publication. Also, because each sample display area requires a custom-made cutout, there will be additional costs incurred for each customer. For example, the samples may fall out at a newsstand when a reader opens the magazine to preview articles. Additionally, liquid samples may rupture, thereby destroying the magazine. Further, because the sample cutout goes through most of the subject magazine, various other advertisers will find their expensive advertisement sitting next to another company's sample product Finally, once the samples are removed from Bullard, the subject publication will still contain holes, and will never look like a magazine again.

U.S. Pat. No. 5,060,814 to Oglesbee discloses a simple molded plastic holder for pediatric product samples. Oglesbee is, however, a stand-alone product container and is not intended to be utilized with a publication as is the holder of the instant invention.

U.S. Pat. No. 5,209,349 to Porter et al. discloses an apparatus for distributing product samples to consumers along with a publication though means of a shrinkwrap covering whereby the products are displayed through recess windows cut out in the display container. Porter, however, increases the thickness of a magazine and prevents viewing of the magazine at a newsstand because of the shrink-wrap encapsulation around the magazine. Porter also covers up the back of the magazine, thereby obscuring the advertisement on the back cover of the magazine. Porter also substantially increases the total weight of a publication and, correspondingly, its mailing costs. Further, should the shrink-wrap container rip, the samples would be lost, and the publication would take on a ragged appearance. Finally, as the sample container must be designed and manufactured to be unique to the size of the particular samples, the additional inherent costs associated therewith may be prohibitive.

A review of the prior art disclosed above indicates that while there have been numerous attempts to devise a means for distributing product samples along with a publication, there remain inherent problems with each one. As described, the use of some of the above devices will result in an increased cost incurred due to the required customization of the sample holder. Others cause the valuable back-page advertisements to be obscured or otherwise lost. Others will result in a significant increase in shipping costs by providing unnecessary bulk and weight to the publication. These devices therefore lack the desired benefit of providing an inexpensive, efficient and standardized means for placing product samples in the hands of magazine subscribers or readers while not adversely affecting the appearance and/or size of the subject publications.

3. SUMMARY OF THE INVENTION

Against the foregoing background, it is a primary objective of the present invention to provide a holder which may be used for distributing sample products and promotional materials.

It is another object of the present invention to provide such a holder that may be attached to the binding of a magazine or publication or any other object with at least one planar surface.

It is another object of the present invention to provide such a holder adapted for use in distributing sample materials to a selected sample of the public, therefore providing an efficient utilization of corporate resources.

It is another object of the present invention to provide such a product sample holder that may be economically produced in mass quantities.

It is another object of the present invention to provide such a holder that allows for maximum product visibility.

It is another object of the present invention to provide such a holder that does not have to be custom-designed in order to hold many different varieties of product samples.

It is another object of the present invention to provide such a holder that does not have to be custom-designed and manufactured for each target publication.

It is another object of the present invention to provide such a holder that appears to be a natural extension of the attached publication.

It is another object of the present invention to provide such a holder that may be distributed by a publisher/advertiser with products consistent with the theme of the subject publication.

It is another object of the present invention to provide such a holder that fits flush against the binding of the publication, thereby allowing the publications to be easily stacked without damaging the holder or the publication.

It is another object of the present invention to provide such a holder that does not obscure or alter the front cover of the publication, thereby preserving the aesthetic newsstand appeal of the publication.

It is another object of the present invention to provide such a holder which does not obscure or alter the back cover of the publication, thereby preserving same as a prime source of advertising revenue.

It is another object of the present invention to provide such a holder that, when attached to a publication, will not alter the flexibility of the publication to permit it to fit into the mailboxes of subscribers.

It is another object of the present invention to provide such a holder that permits potential purchasers of the attached publication to review the subject publication at a newsstand.

It is another object of the present invention to provide such a holder that may be of a clear plastic which allows for easy and quick identification of the particular products enclosed, thereby providing both increased impact on potential consumers as well as additional incentive for prospective newsstand customers to purchase the publication.

It is another object of the present invention to provide such a holder that may be segmented so as to provide safe encapsulation for a plurality of product samples.

It is another object of the present invention to provide such a holder that is easily attached to the subject publication by non-permanent adhesive means so that it will not interfere with the production of the subject publication.

It is yet another object of the present invention to provide such a holder that may be easily and fully detached from the subject publication without harming its binding, the cover art or the back cover advertising.

It is yet another object of the present invention to provide such a holder that is designed to be discarded after use.

It is yet another object of the present invention to provide such a holder of product samples and promotional materials that act as incentives to purchase the subject publication over other publications on display, therefore increasing the sales of the publication.

It is yet another object of the present invention to provide such a holder that consists of a fully enclosed tube, thereby ensuring excellent protection of the product samples as well as an effective means of protecting the products from tampering.

To the accomplishments of the foregoing objects and advantages and to address the above concerns in a manner distinguishable from the prior art, the present invention, in brief summary, comprises a housing of plastic, plastic product holding containers or other methods of packaging sample products or promotional materials, and a clear adhesive tape fastening means to bind same to a square, "perfect," glued-type binding of a publication. The holder is designed for a custom fit to the binding of the publication, thereby providing a sample product holder which will appear as if it belonged as a part of the magazine in question, and will be adaptable to be mailed to magazine subscribers or easily displayed for purchase at a newsstand.

4. BRIEF DESCRIPTION OF THE DRAWINGS

The above and other objects, features and advantages of the present invention will become apparent from the following detailed description of the accompanying drawings in which.

5. DETAILED DESCRIPTION OF THE INVENTION

Figure 1:
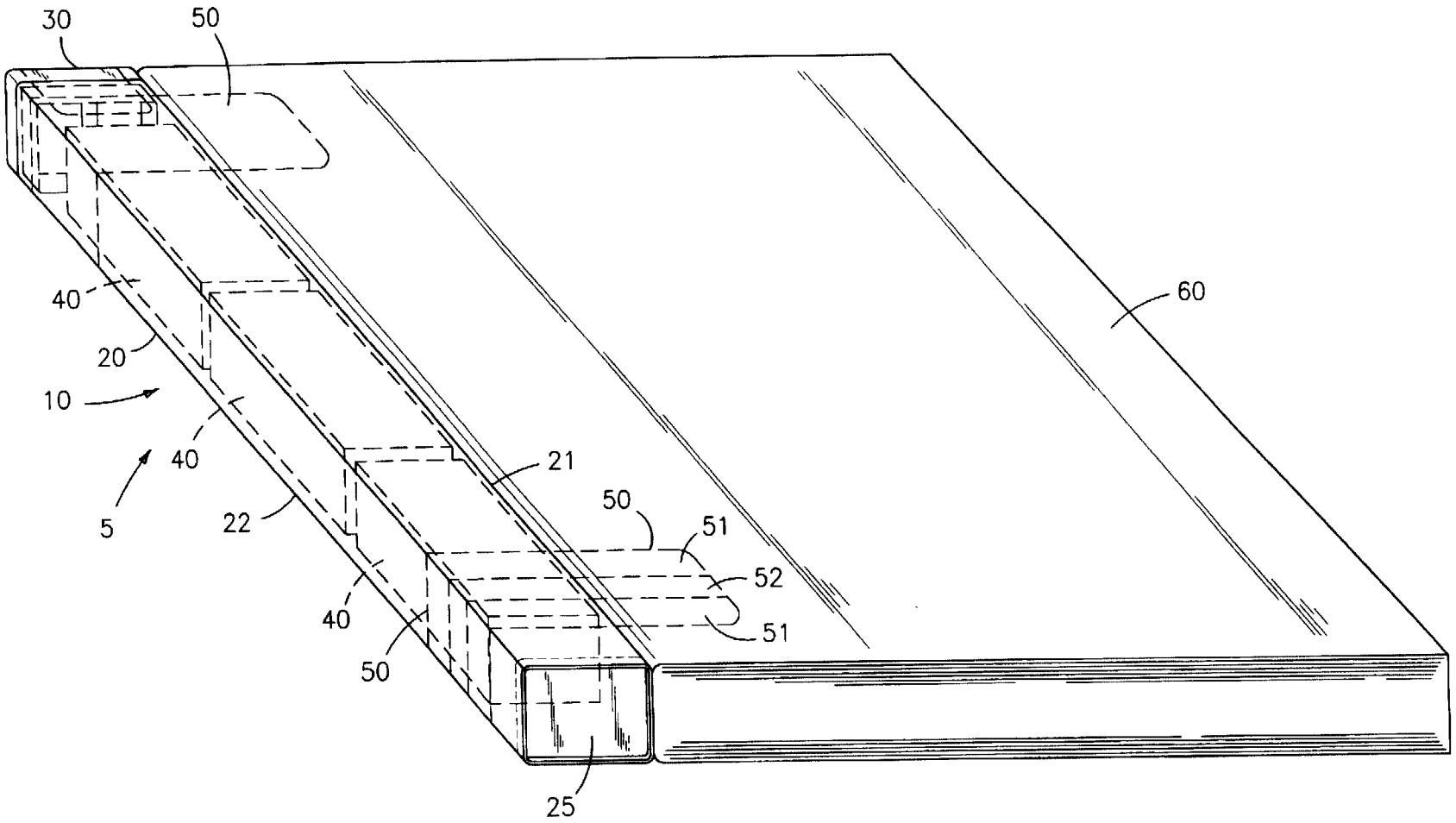
FIG. 1 is a front perspective view of an embodiment of the holder of the present invention as attached to a magazine.
Figures 2, 3, 4, 5A, 5B:
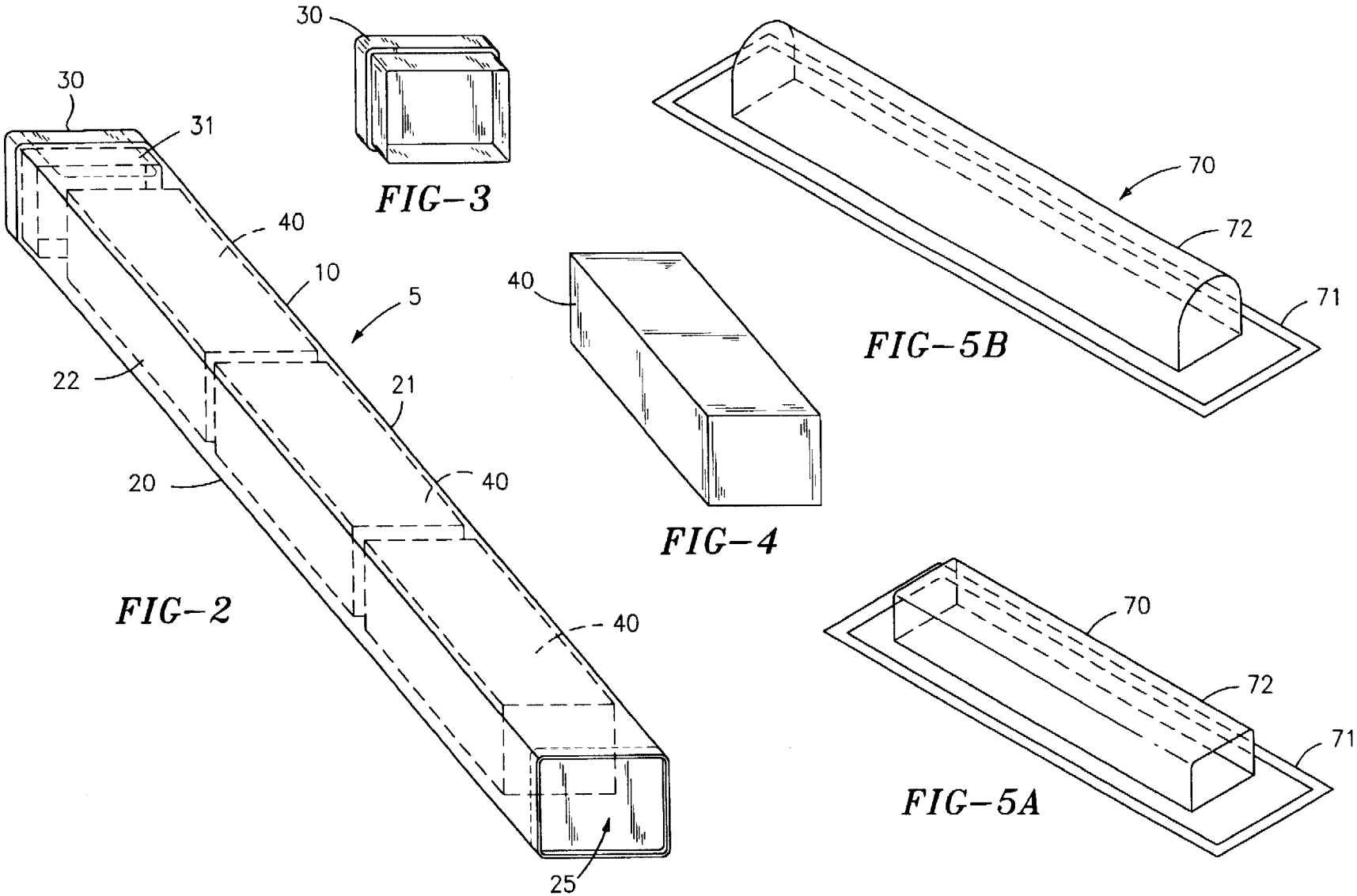
FIG. 2 is a perspective view of the holder of FIG. 1 independent of the magazine.
FIG. 3 is a perspective view of the tube end closure of the holder.
FIG. 4 is a perspective view of the sample/product container as depicted in FIGS. 1 and 2.
FIG. 5A is a perspective view of an alternate embodiment of the sample/product container of the holder.
FIG. 5B is a perspective view of another alternate embodiment of the sample/product container of the holder.

Referring to the Figures and, in particular, FIGS. 1 and 2, the Binding Product Holder of the present invention, referred to generally by reference numeral 5, comprises a housing 10 which includes a tube 20, an end closure plug 30, at least one individual product container 40, a permanent plastic welded end closure 25 and a fastening means 50 utilized to fasten the housing 10 to a publication such as, for example, magazine 60. Tube 20 is generally in a long rectangular shape. In a preferred embodiment, the corners of the tube 20 may be slightly rounded, but the surfaces sufficiently planar so as to permit the interior edge 21 of the tube 20 to mount flush with the square binding of the magazine 60 and to permit the exterior edge 22 of the tube 20 to be coded with information such as the name of the publication, month/issue and publishing code information. The latter may be accomplished through direct printing or by placing an adhesive label thereon.

Tube 20 is made from a thin, clear Cellulose Propionate plastic material about 0.01 to 0.040 inches thick, and, as such, is both inexpensive to obtain and manufacture, and may be easily disposed of. The length of tube 20 should not be longer than the length of the magazine binding to which it is adopted to be attached. Similarly, the height of tube 20 should be equal to, but not greater than, the thickness of the magazine to be attached thereto in order to optimize space for the distribution of the sample products. Should the height of tube 20 exceed the thickness of the magazine binding, the magazines will not stack properly on top of each other. Moreover, it will impede distribution thereof, or will tend to snag against the edges of other magazine's holders, thus tearing the magazine or separating the holder from the magazine. Further, the preferred measurements will cause the tube 20 to look as if it were a natural extension of the magazine itself.

The width of the tube 20 should preferably be twice the thickness of the binding of the subject magazine. However, the width may be reduced in order to house smaller samples or expanded in order to secure additional space, provided that the width is not expanded to such an extent as to put undo cantilever stress on the adhesive attachment so as to separate tube 20 from magazine 60.

The product containers 40 are adapted to hold the individual product samples and are then inserted into tube 20. In such embodiment, product containers 40 consist of rectangular cardboard boxes or carded blister pack containers 70 of a height and width slightly less than that of tube 20 in order to properly house the particular product sample and protect the sample during shipping, and yet retain the ability to be easily slipped in and out of tube 20. The number of containers 40 to be enclosed in any particular tube 20 is dependent upon the dimensions of the product samples themselves and the length of tube 20. Thus, for large samples, there may be room for only one product container 40. As an additional means of promoting the product samples enclosed and possibly providing additional incentive for prospective newsstand purchasers, the trademark and/or logo of the product sample manufacturer may be imprinted upon product container 40.

FIGS. 5A and 5B illustrate two alternative embodiments to the carded blister pack containers 70. Carded blister packaging generally consists of a paperboard blister card 71 and a clear plastic molded blister shell 72. The plastic blister shell 72 is molded to conform to the product being packaged. The dimensions of the blister card 71 and plastic blister shell 72 are sufficiently less than those of the tube so as to allow the carded blister pack containers 70 to fit within the tube 20. The plastic blister shell 72 housing the sample product or promotional material is sealed to the blister card 71.

In alternative embodiments (not shown) of the present invention, product samples may be carried in alternative forms in tube 20. Such alternative forms include, but are not limited to, single trays which extend the length of the tube, open-ended boxes, boxes with window cutouts (for viewing the product samples), small folding cartons, boxes with sleeves and matchbox-like trays. A segmented product holder may also be built directly within the cavity of tube 20.

In the preferred embodiment, one end of tube 20 is permanently sealed with a plastic welded end closure 25, while the other end will remain open to permit easy insertion of product containers 40. The open end may then be sealed by means of a removable closure plug 30. Closure plug 30 is adapted to fit snugly into tube 20 in order to help prevent the product containers from falling out during transport. A removable adhesive seal 31 is then placed over closure plug 30 and tube 20 in order to secure closure plug 30 in place on tube 20. The use of seal 31 in connection with closure plug 30 will also prevent tampering and/or premature removal of the product samples.

In an alternate embodiment (not shown), both ends of tube 20 are permanently sealed with plastic welded end closures 25. Tube 20 is then cut into two sections and the product sample containers 40 are inserted. Tube 20 is then reassembled and the cut is sealed by adhesive means.

Once the product holder tube 20 has been filled with product sample containers and sealed, it is then affixed to the binding of magazine or publication 60. As noted above, this invention is designed to be used in connection with magazines or publications which have a square "perfect" glued type binding, and not the type of binding which is fan-folded and then stapled in the middle. Tube 20 is positioned lengthwise adjacent to the binding of publication 60 and affixed thereto by means of clear adhesive tape 50. In the preferred embodiment, two strips of adhesive tape 50 are applied at opposite ends of tube 20 to properly secure tube 20 in place and to prevent detachment during shipping. However, the number of strips of adhesive tape 50 which are to be utilized may vary, dependent upon the length and thickness of magazine/publication 60. Clear adhesive tape is also preferred, as it will prevent the front cover of the magazine from being obscured, thereby preserving the aesthetic newsstand appeal of the publication. Clear adhesive tape also prevents alteration or modification to the back cover of the magazine, thereby preserving same as a prime source of advertising revenue.

Adhesive tape 50 further comprises two adhesive strips 51 with a non-adhesive strip 52 between adhesive strips 51. This unique design of the adhesive tape 50 permits the purchaser of the magazine to easily remove the holder 10 from the magazine 60 by grasping the tube 20 and removing the adhesive tape 50 by the non-adhesive center strip 52 of adhesive tape 50. The magazine subscriber/purchaser may then break seal 31, remove plug 30 and remove the product containers 40. It should also be noted that the use of a flexible adhesive tape 50 to secure the Binding Product Holder to the magazine allows the magazine to be folded or rolled in order to be placed in a subscriber's mailbox without damaging the magazine or causing the Binding Product Holder to be damaged or detached.

Having thus described the invention with particular reference to the preferred forms thereof, it will be obvious that various changes and modifications can be made therein without departing from the spirit and scope of the present invention as defined by the appended claims. In that regard, while the Binding Product Holder of the present invention is intended to be used in connection with a magazine or publication, the potential applications of this invention need not be so limited. The Binding Product Holder of the instant invention may also be used in connection with virtually any consumer product with a planar siding or binding. Thus, it could also be used in connection with books or publications such as telephone books and corporate annual reports and literature. The Binding Product Holder could also be used to attach premiums to cereal boxes, or to promote sample pharmaceutical products when attached to boxed medicine packages. Furthermore, the material components of the Binding Product Holder need not be limited to clear plastic. Various other materials may be utilized, depending upon the publication and the products enclosed. These materials may be transparent, translucent or even opaque and of a variety of colors or thicknesses.

Wherefore, I claim:

1. An enclosed, tubular shaped holder adapted to be releasably secured to the cover of a periodical publication of the type having a front cover, back cover and spine, said holder adapted to display and distribute at least one promotional item and including:

a pair of opposed clear top and bottom surfaces between which said at least one promotional item may be contained and viewed, wherein the distance between the top of said top surface and the bottom of said bottom surface is equal to the thickness of said publication, and the length of said top and bottom surfaces is equal to the length of said publication;

a pair of opposed side surfaces which, in combination with said pair of top and bottom surfaces form said tubular shaped holder;

a pair of opposed end portions through which said at least one promotional item may be inserted into and removed from said holder;

releasable closure means for releasably closing at least one of said end portions; and means for releasably securing said holder to said publication so as not to obscure said front cover or said back cover, such that one of said side surfaces is juxtaposed to the spine of said publication.

2. The holder of claim 1, wherein said top and bottom surfaces consist of a plastic material.

3. The holder of claim 1, wherein said releasable closure means consists of a plug adapted to be releasably secured to said holder within at least one of said end portions.

4. The holder of claim 1, wherein one of said opposed end portions is permanently sealed.

5. The holder of claim 1, wherein said at least one promotional item consists of a plastic blister pack adapted to be slidably inserted within said holder by insertion through said at least one end portion.

6. The holder of claim 1, wherein said at least one promotional item consists of a rectangular box adapted to be slidably inserted within said holder by insertion through said at least one end portion.

7. An enclosed, tubular shaped holder made of a plastic material adapted to be releasably secured to the cover of a periodical publication of the type having a from cover, back cover and spine, said holder adapted to display and distribute at least one promotional item and including:

a pair of opposed clear top and bottom surfaces between which said at least one promotional item may be contained and viewed, wherein the distance between the top of said top surface and the bottom of said bottom surface is equal to the thickness of said publication;

a pair of opposed side surfaces which, in combination with said pair of top and bottom surfaces, form said tubular shaped holder;

a pair of opposed end portions through which said at least one promotional item may be inserted into and removed from said holder, wherein one of said end portions is permanently sealed;

releasable closure means for releasably closing the end portion that is not permanently sealed, said releasable closure means consisting of a plug adapted to be releasably secured to said holder; and means for releasably securing said holder to said publication so as not to obscure the front or back cover of said publication, such that one of said side surfaces is juxtaposed to the spine of said publication.

* * * * *